US005753839A

United States Patent [19]

McFarlin

[11] Patent Number: 5,753,839

[45] Date of Patent: May 19, 1998

[54] MUSICAL INSTRUMENT SUPPORT STRAP

[76] Inventor: Bill McFarlin, Rt. 4, Box 71, Williston, N. Dak. 58801

[21] Appl. No.: 811,469

[22] Filed: Mar. 3, 1997

[51] Int. Cl.[6] ..... G10D 7/10

[52] U.S. Cl. ..... 84/387 A; 84/91; 84/603; 84/258

[58] Field of Search ..... 84/387 A, 379, 84/453; 224/910, 603, 268, 269, 258

[56] References Cited

U.S. PATENT DOCUMENTS 4,401,246 8/1983 Dickinson et al. ..... 224/910

4,802,613 2/1989 Tierney ..... 84/387 A

*Primary Examiner*—Cassandra C. Spyrou

*Attorney, Agent, or Firm*—Joseph J. Zito

[57] ABSTRACT

A musical instrument support strap worn around the neck of a musician to support an instrument adjacent the musician at a desired height and/or orientation. The strap provides a buckle for adjusting the height of the instrument and a fastener for opening the loop portion of the strap worn around the musician's neck. The strap can also include a pad positioned to cushion the weight of the instrument on the neck of the musician. A musical instrument support strap with a split neck loop avoids the inconveniences of convention support straps by eliminating the need to readjust the height setting of the supported instrument each time the strap is worm by the musician. The split loop strap also eliminates the disadvantages of having to pull a closed loop over the head of the musician each time the musician wears the strap. Providing a constant setting also improves a student's confidence and familiarity with the instrument.

3 Claims, 2 Drawing Sheets

MUSICAL INSTRUMENT SUPPORT STRAP

BACKGROUND OF THE INVENTION

The present invention relates to straps and holders for musical instruments. More specifically, the present invention relates to straps worn by a musician for supporting a musical instrument while playing the instrument.

Wind instruments, such as the saxophone are often supported by a strap worn around the neck of the musician playing the instrument. Other instruments can also be supported in a similar manner. The instrument support strap has a continuous neck loop portion for encircling the neck of the musician and an instrument clip extending from the strap. The instrument must be supported at the proper height by the instrument clip to allow for comfortable playing. The neck loop must also be adjustable to be able to slip over the head of the musician when taken on and off. Each adjustment of the neck loop causes a change in the height of the instrument strap. Conventional wind instrument support straps are inconvenient because the require constant adjustment each time they are used. Beyond the inconvenience caused to an experienced musician, changes in instrument height can be an impediment to a student who is trying to become familiar with positioning and playing of an instrument.

Conventional neck straps can also mess the hair of a musician and catch on his nose when they are pulled over the musician's head.

SUMMARY OF THE INVENTION

The musical instrument neck strap of the present invention is designed to avoid the inconvenience and impression associated with conventional neck straps. The present invention allows the musician to adjust and set the height of his instrument. Once the instrument height is set, there is no need to readjust the setting. The strap can be placed around the neck of the musician and removed without disturbing the height setting. Each time the musician uses the strap, the instrument is positioned at the same height as the previous height.

The strap of the present invention has a split neck loop which is positioned around the neck and fastened. The strap of the present invention is not slipped over the head of the musician, thus avoiding the need for readjustment and avoiding other inconveniences.

The present invention utilizes two separate fasteners, one for adjusting the height of the musical instrument the other for completing the neck loop. The first height adjusting fastener is a set and hold type fastener which retain its setting without slipping. Once the height is set using the first fastener, the second fastener can be released and reconnected without disruption or adjustment of the height setting fastener.

DETAILED DESCRIPTION OF EXEMPLARY EMBODIMENTS

Figure 1:
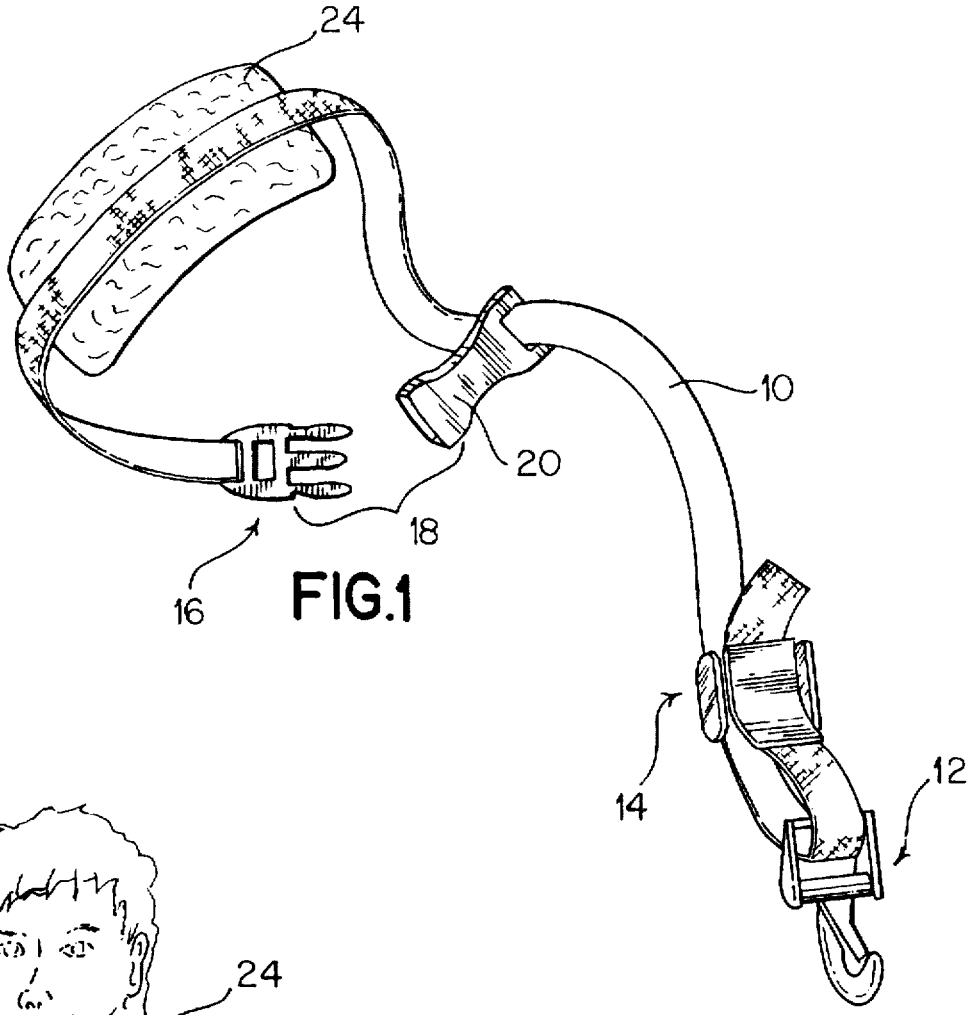
FIG. 1 is a perspective overall view of the instrument support strap of the present invent.

FIG. 1 illustrates the various components of the support strap of the present invention. A continuous ribbon of material forms the main body 10 of the strap. One end of the body 10 is looped through an instrument clip 12 and doubled back through height adjustment buckle 14.

The opposite end of the body 10 is attached to one half 16 of the loop completing fastener 18. The other half 20 of the loop completing fastener 18 is attached to the body at a position to allow for sufficient length to loop around the neck of the musician. An optional pad 24 can be positioned along the length of the body to rest against the back of the musician's neck, as illustrated in FIGS. 2 and 3.

FIG. 1 illustrates a cam buckle type fastener as an example of one type of adjustable fastener which can be used for the height adjustment buckle 14 of the present invention. Any suitable fastener which allows for adjustment of the length of the strap can be utilized without departing from the scope of the invention. Similarly, FIG. 1 also illustrates a side release fastener as an example of one type of releasable fastener which can be used as the loop completing fastener 18 of the present invention. Any suitable fastener which allows for disconnection and reconnection can be used without departing from the scope of the invention.

Figure 2:
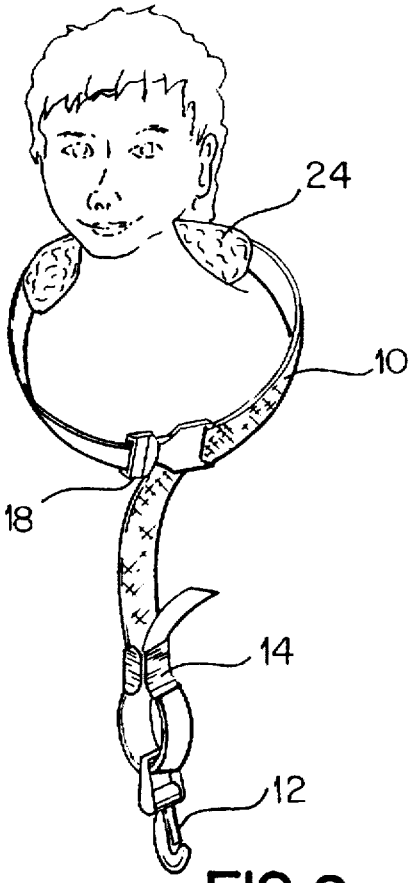
FIG. 2 is a perspective front view of the support strap of the present invention in use,by a musician to support a saxophone.
Figure 3:
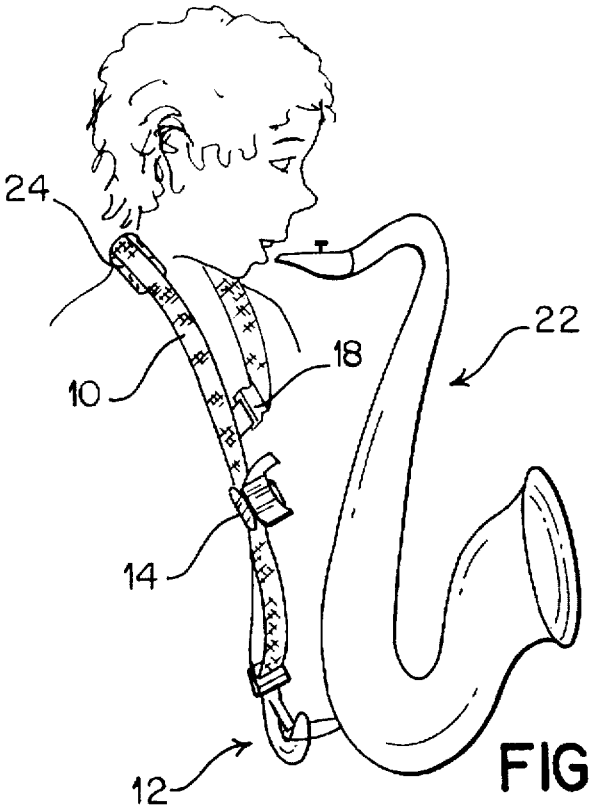
FIG. 3 is a side view of the support strap of the present invention in use by a musician to support a saxophone.

When in use, as illustrated in FIGS. 2 and 3, the loop portion of the body 10 is placed around the musician's neck and the loop is completed by engagement of the two halves 16 and 20 of loop completion fastener 18. The height of the instrument 22 is then adjusted and set through manipulation of height adjustment buckle 14. For removal, the musician disengages loop completion fastener 18 and removes the support strap without any change to the setting of height adjustment buckle 14. Once adjusted and set, the height of the instrument 22 will remain constant even when the support strap is removed and then reattached any number of times.

Figure 4:
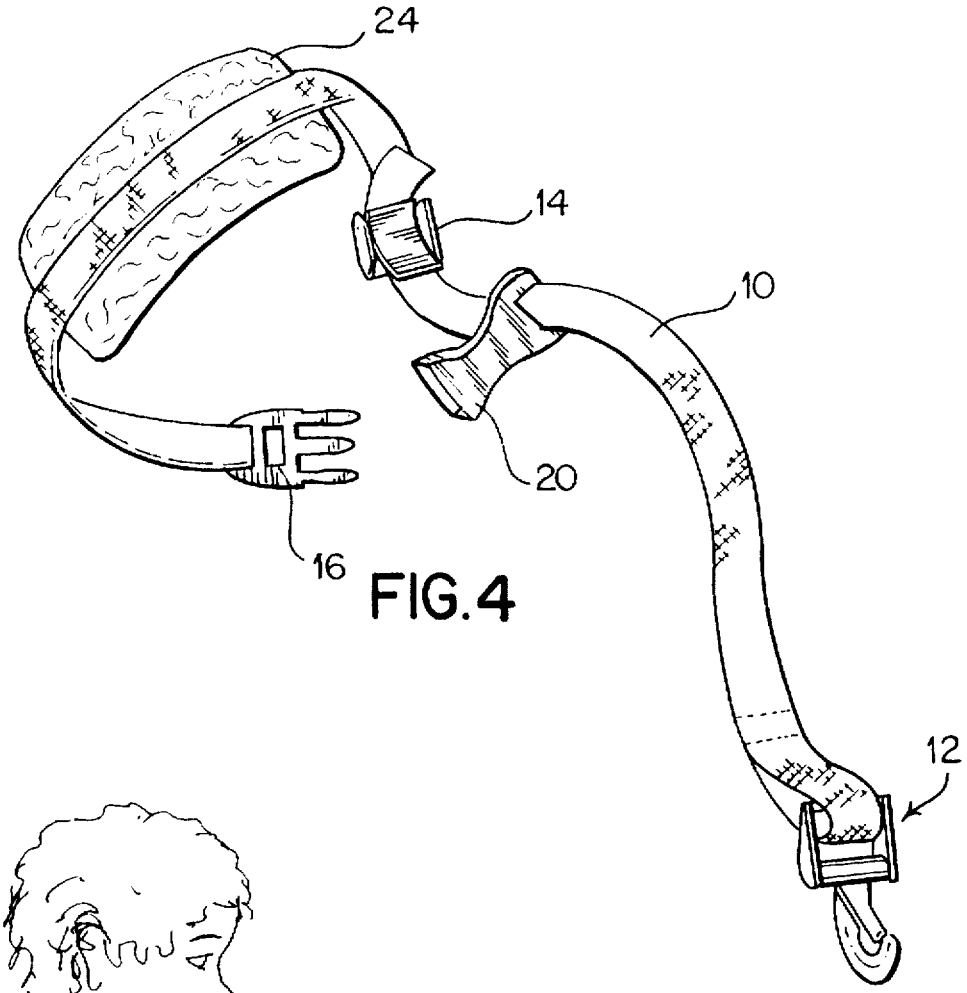
FIG. 4 is a perspective overall view of the instrument support strap of the present invention illustrating an alternative buckle location.

FIG. 4 illustrates a strap in accordance with the teachings of the present invention which teaches an alternative location for the adjustment buckle 14. The buckle 14 of the strap illustrated in FIG. 4 is located in the loop portion of the strap instead of the portion between the loop and the instrument clip 12. Location of the buckle 14 along the loop portion of the strap also allows for adjustment of the loop size, if desired. As is known in the art, the loop is cut to accommodate Buckle 14. One side of Buckle 14 is fixed to one cut end of the loop the other cut end of the loop is engaged by the buckle mechanism.

Manner other devices and methods can be constructed and implemented given the teachings of the present invention as described above and those are considered within the scope of the inventive concept as herein taught. The above description is for the purpose of illustrating several exemplary embodiments of the present invention and is not intended to limit the scope of the invention as defined in the following claims:

I claim:

1. A musical instrument support strap for supporting an instrument at a desired playing position, comprising:

a strap body extending from a first free end to a second free end, a loop completion fastener having a first portion and a second portion; the first portion secured to said first free end of said strap body and said second portion secured to said strap body between said first free end and said second free end; said first portion releasably engaging said second portion to form a first strap loop;

an instrument clip supported by said strap body between said second portion of said loop completion fastener and said second free end of said strap body; said strap body between said instrument clip and said second free end being secured to said strap body between said second portion of said loop completion fastener and said instrument clip to form a second strap loop.

2. The musical instrument support strap according to claim 1, wherein said strap body between said instrument clip and said second free end is secured to said strap body between said second portion of said loop completion fastener and said instrument clip by an adjustable buckle.

3. The musical instrument support strap according to claim 1, wherein an adjustable buckle is provided on said strap body between said first portion and said second portion of said loop completion fastener.

* * * * *